US006846183B2

(12) United States Patent
Kato et al.

(10) Patent No.: US 6,846,183 B2
(45) Date of Patent: Jan. 25, 2005

(54) JUNCTION BOX HAVING A PLURALITY OF MAIN CASINGS AND CONNECTORS DESIGNED FOR USE WITH DIFFERENT TYPES OF AUTOMOBILES

(75) Inventors: Shinshu Kato, Yokkaichi (JP); Katsuya Ito, Yokkaichi (JP); Kouichi Shirouzu, Nishikamo-gun (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/725,060

(22) Filed: Dec. 2, 2003

(65) Prior Publication Data

US 2004/0121623 A1 Jun. 24, 2004

(30) Foreign Application Priority Data

Dec. 19, 2002 (JP) ..... 2002-368890

(51) Int. Cl.[7] ..... H01R 39/00
(52) U.S. Cl. ..... 439/20; 439/76.2; 439/949
(58) Field of Search ..... 439/76.2, 949, 439/701

(56) References Cited

U.S. PATENT DOCUMENTS 5,295,870 A 3/1994 Rei et al.
5,624,280 A * 4/1997 Kato ..... 439/724
5,626,492 A * 5/1997 Onizuka et al. ..... 439/512
5,744,751 A * 4/1998 Kasai ..... 174/52.1
5,915,978 A * 6/1999 Hayakawa et al. ..... 439/76.2
6,162,990 A * 12/2000 Sakamoto ..... 174/59
6,332,813 B1 * 12/2001 Okabe et al. ..... 439/701
6,375,517 B1 * 4/2002 Okabe et al. ..... 439/701
6,383,035 B1 * 5/2002 Kasai ..... 439/724
6,471,553 B2 * 10/2002 Kasai ..... 439/724
6,661,672 B2 * 12/2003 Ito ..... 361/752

FOREIGN PATENT DOCUMENTS

JP A 2001 145231 5/2001
JP A 2001-177950 6/2001

* cited by examiner

*Primary Examiner*—Hae Moon Hyeon
(74) *Attorney, Agent, or Firm*—Oliff & Berridge, PLC

(57) ABSTRACT

A junction box comprises small size standard boxes. The small size standard box includes a main casing that contains many longitudinal bus bars disposed in parallel with one another at a given interval in distance therein, and male and female coupling portions provided on the outer opposite side surfaces of the main casing. Plural small size standard boxes are juxtaposed together in accordance with different kinds of automobile vehicles by interconnecting the male and female coupling portions successively. A lower casing member is attached to the main casing. The size of the lower casing member depends on the number of the standard boxes to be coupled for a special purpose. The lower casing member is provided with an attachment portion for a vehicle body projecting from the member.

13 Claims, 11 Drawing Sheets

Fig. 11A
RELATED ART
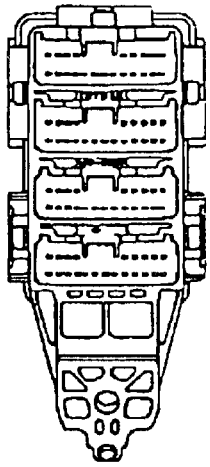
Fig. 11B
RELATED ART
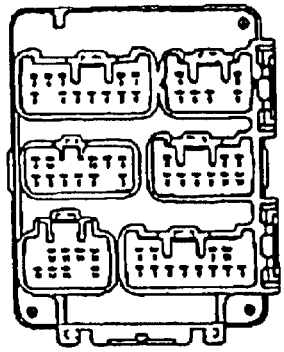
Fig. 11C
RELATED ART
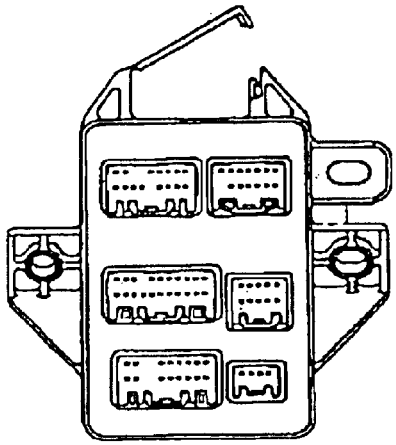
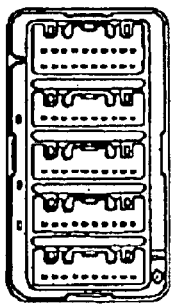
Fig. 11D
RELATED ART
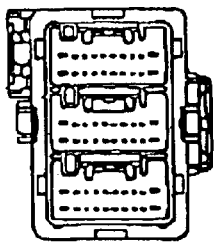
Fig. 11E
RELATED ART

JUNCTION BOX HAVING A PLURALITY OF MAIN CASINGS AND CONNECTORS DESIGNED FOR USE WITH DIFFERENT TYPES OF AUTOMOBILES

CLAIM FOR PRIORITY

This application claims priority to Japanese Patent Application No. 2002-368890 filed Dec. 19, 2002, the entire disclosure of which is incorporated herein by reference in its entirety.

BACKGROUND OF THE INVENTION

1. Field of Invention

This invention relates to a junction box and more particularly to a junction box in which a plurality of small size standard boxes are coupled to one another to be used in different types of automobile vehicles.

2. Description of Related Art

Heretofore, in order to easily change a bus bar circuit in a junction box that is to be mounted on an automobile vehicle, Japanese Patent Public Disclosure 2001-145231 has proposed a junction box.

A prior art connector will be described by referring to FIGS. 10 and 11. FIG. 10 is an exploded perspective view of a conventional junction box. FIGS. 11A to 11E are plan views of junction boxes to meet special purposes for various kinds of automobile vehicles.

With reference to FIG. 10, the junction box 1 includes an upper casing member 2 and a lower casing member 3. Longitudinal bus bars 4 are accommodated in parallel with one another in an interior defined between the upper and lower casing members 2 and 3. Each of the bus bars 4 includes a plate-like bus bar body 4*a*, tabs 4*b* that project from the bus bar body 4*a* toward the upper casing member 2, and insulation displacement blades 4*c* which project from the bus bar body 4*a* toward the lower casing member 3. An electrical cable 5 is pushed into the insulation displacement blades 4*c* of different bus bars 4. It is possible to easily alter a bus bar circuit by electrically coupling the different bus bars 4 to one another.

The above junction box can carry out a circuit alteration easily to a certain extent. However, since the electrical cable 5 electrically couples the longitudinal bus bars 4 in a single junction box 1, the circuit alteration is limited within a scope and such structure cannot be applied to a great circuit alteration such as an alteration for a different type of an automobile vehicle. As shown in FIGS. 11A to 11E, each junction box must be developed for the special purpose of a particular type of an automobile vehicle. Consequently, there are problems of increase in man-hours for development of each junction box and also the cost of a die for the bus bar.

Accordingly, an object of the present invention is to provide a junction box that can reduce man-hours for the development of a junction box and also lower the cost of a die for a bus bar by sharing the junction box.

SUMMARY OF THE INVENTION

In order to solve the above problems, the invention is directed to a junction box comprising a plurality of small size standard boxes. Each of the standard boxes may include a main casing that contains circuit parts, and male and female coupling portions can be provided on the outer opposite side surfaces of the main casing. The plural small size standard boxes are juxtaposed together in accordance with the different types of automobile vehicles by interconnecting the male and female coupling portions successively. A lower casing member may be attached to the main casing. The size of the lower casing member depends on the number of the standard boxes to be coupled for a particular purpose. The lower casing member can be provided with an attachment portion for a vehicle body that projects from the member.

According to the above structure, it is possible to provide a small size standard box that can be commonly used in different types of automobile vehicles, to couple plural standard boxes to one another in accordance with a special requirement, to accommodate the coupled standard boxes together in a single lower casing member, and to produce a junction box in compliance with the different types of automobile vehicles. Since the lower casing member can be provided in accordance with the number of the coupled standard boxes and the main casing and bus bars that have complex structures can be shared respectively, it is possible to reduce man-hours for development of a junction box and also lower the cost of a die for the bus bar.

Each of the small size standard boxes may contain many longitudinal bus bars disposed in parallel with one another at a given interval in distance therein. Each of the bus bars may also include a strap-like portion extending horizontally, a plurality of tabs projecting vertically from an upper edge of the strap-like portion at a given interval in distance, and a plurality of insulation displacement terminals projecting vertically from a lower edge of the strap-like portion at a given interval in distance. The tabs can be inserted into a connector containing section provided on an upper surface of each of the standard boxes. A jumper cable or a conductive pin may be connected to the insulation displacement terminals so that any longitudinal bus bar selected from the many juxtaposed longitudinal bus bars are electrically coupled to one another.

The tabs project from the upper edge of the strap-like portion vertically at the given interval in distance. On the other hand, the insulation displacement terminals project from the lower edge of the strap-like portion vertically at the given interval in distance. The strap-like portion can be cut off or divided at desired positions in accordance with the circuit structure or, alternatively, any unnecessary insulation displacement terminals can be cut off.

According to the above structure, the jumper cable or conductive pin can be pushed into the insulation displacement terminals provided on the bus bars so that any longitudinal bus bars selected from the juxtaposed longitudinal bus bars may be coupled to one another. Therefore, it is possible to easily change the bus bar circuits, enlarge applicability for the small size standard box, and apply the standard box to complex circuit construction.

The jumper cable or the conductive pin may be connected to the insulation displacement terminals of the bus bars in the interconnected standard boxes to electrically couple the longitudinal bus bars between different standard boxes.

According to the above structure, it is possible to easily change the bus bar circuits, enlarge applicability for the small size standard box, and apply the standard box to complex circuit constructions. It is also possible to eliminate a connector containing section for interconnecting the standard boxes and thus to downsize the standard box.

BRIEF DESCRIPTION OF THE DRAWINGS

The features of the invention are believed to be novel and the elements characteristic of the invention are set forth with particularity. The figures are for illustration purposes only and are not drawn to scale. The invention itself, however, both as to organization and method of operation, may best be understood by reference to the detailed description which follows taken in conjunction with the accompanying drawings in which:

FIGS. 11A to 11E are plan views of junction boxes to meet special purposes for different types of automobile vehicles.

DETAILED DESCRIPTION OF PREFERRED EMBODIMENTS

Figure 1:
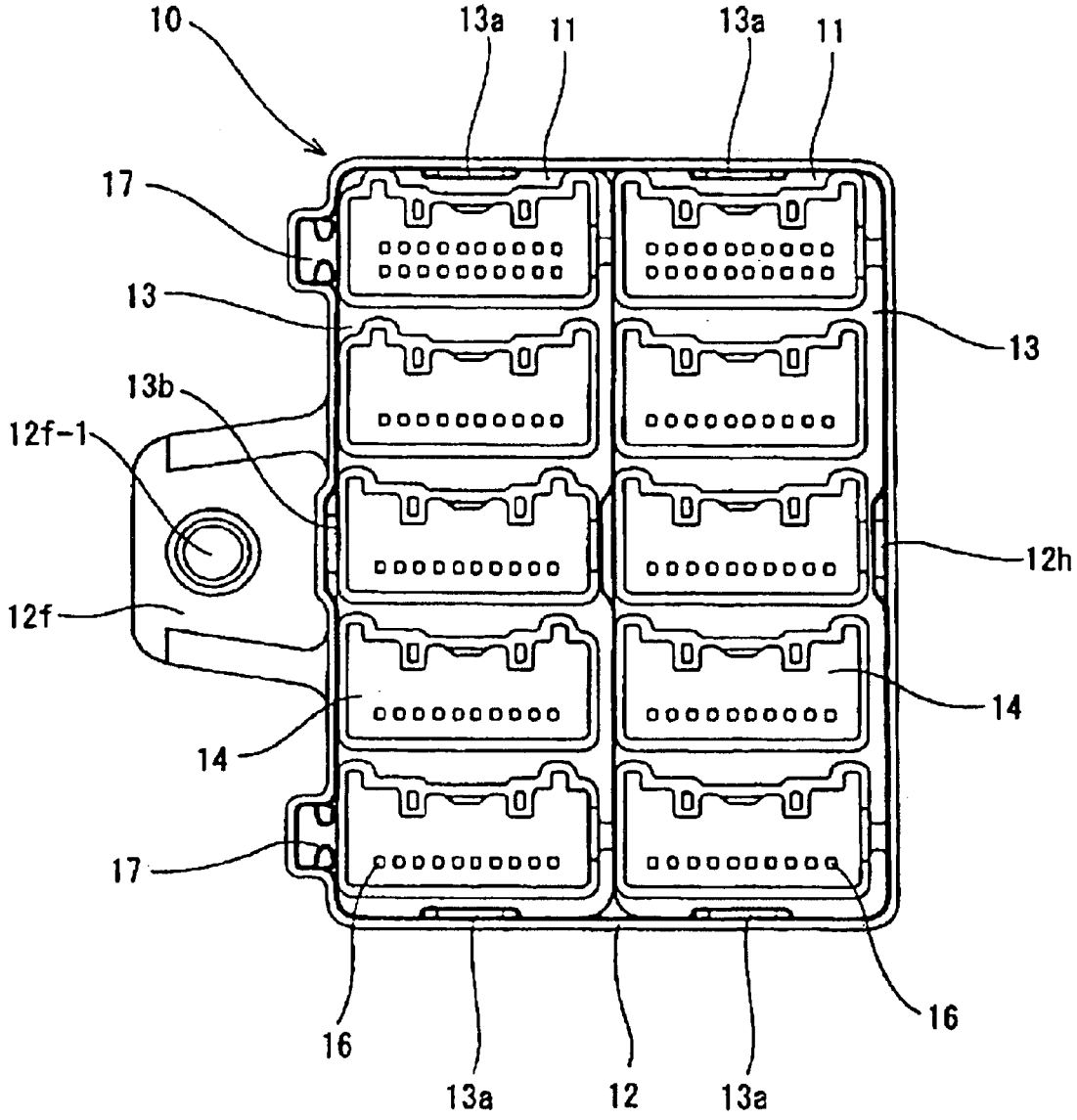
FIG. 1 is a plan view of a first embodiment of a junction box in accordance with the present invention.

In describing exemplary embodiments of the present invention, reference will be made herein to FIGS. 1 to 9 of the drawings in which like numerals refer to like features of the invention. Features of the invention are not necessarily shown to scale in the drawings.

Referring now to the drawings, a first embodiment of a junction box 10 in accordance with the invention will be described below in FIGS. 1 to 6. The junction box 10 includes two coupled small size standard boxes 11 and a lower casing member 12 containing the standard boxes 11.

Figure 2:
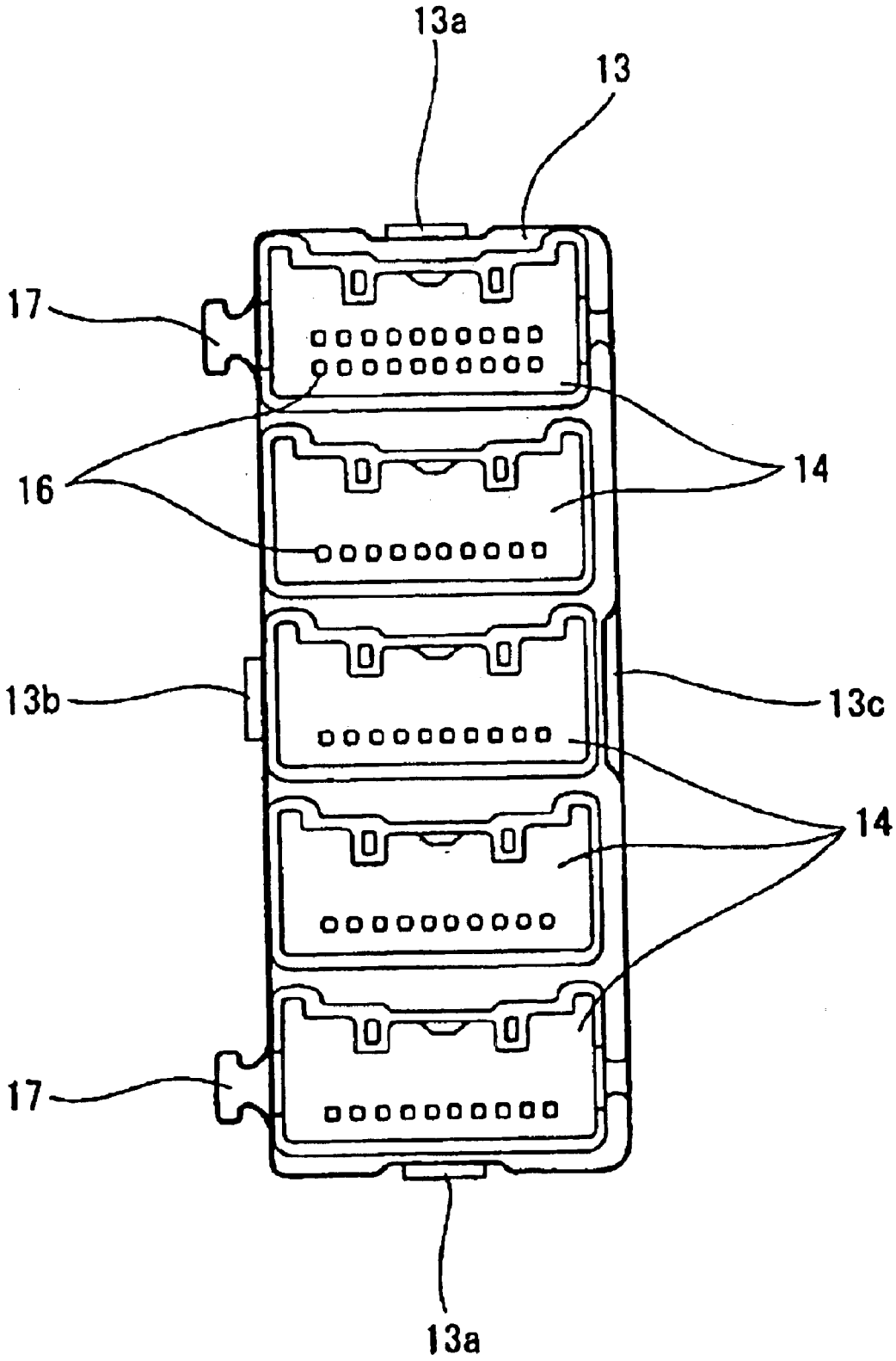
FIG. 2 is a plan view of a body casing.
Figure 3:
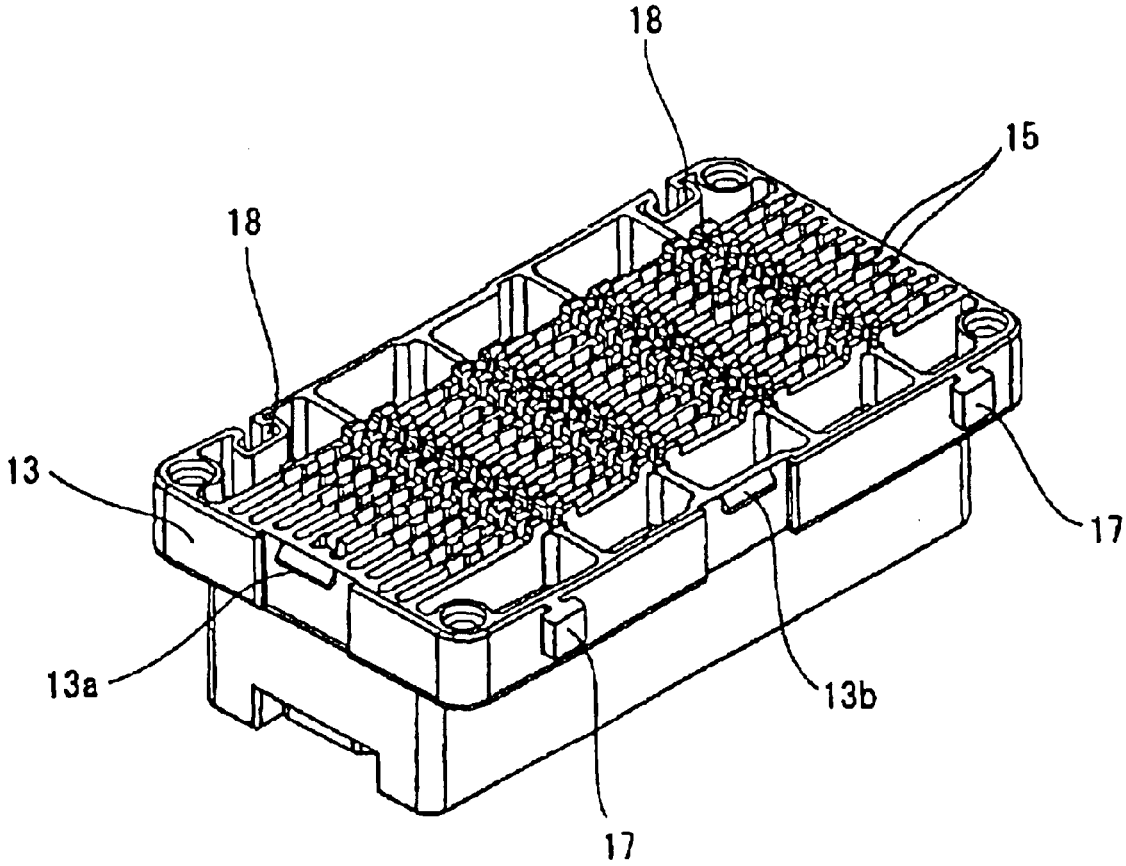
FIG. 3 is a perspective view of the body casing, illustrating a bottom side of the body casing.
Figure 4:
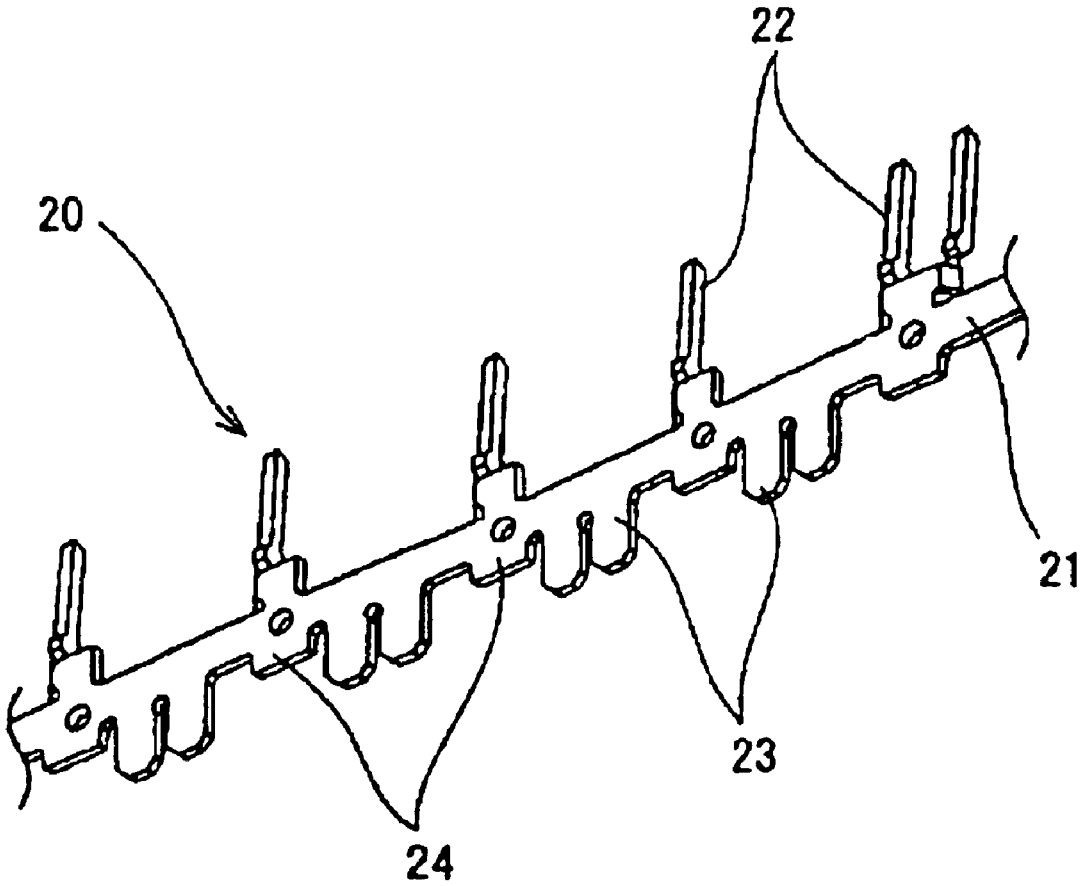
FIG. 4 is a perspective view of a longitudinal bus bar.

FIGS. 2 and 3 show the standard box 11. A main casing 13 of the standard box 11 is provided on a top surface thereof with five connector containing sections 14. A bottom surface of main casing 13 has bus bar containing sections 15 that accommodate longitudinal bus bars 20 (FIG. 4). Also, terminal holes 16 extend between the bus bar containing sections 15 and the connector containing sections 14. The main casing 13 may also be provided on one sidewall thereof with male coupling portions 17 and on the other sidewall may be provided with female coupling portions 18. The portions 17 and 18 can be arranged opposite in direction to each other on the sidewalls so as to couple the adjacent standard boxes 11 to each other. Lock pawls 13*a* that can engage with lock holes 12*g* (FIG. 6) in the lower casing member 12 may be provided on longitudinal opposite ends of the main casing 13. A lock pawl 13*b* may also be provided on the main casing 13 at a substantially central position of the sidewall on which the male coupling portions 17 are provided. A lock portion 13*c* may be provided on the opposite sidewall of the main casing 13. The lock portion 13*c* may be arranged opposite in direction to the lock pawl 13*b*.

FIG. 4 shows a longitudinal bus bar 20. The longitudinal bus bar 20 includes a strap-like portion 21 extending horizontally, tabs 22 projecting vertically from an upper edge of the strap-like portion 21 at a given interval in distance, insulation displacement terminals 23 projecting vertically from a lower edge of the strap-like portion 21 at a given interval in distance, and protrusions 24 projecting vertically from a lower edge of the strap-like portion 21 at a given interval in distance. The protrusions 24 are opposite in direction to the tabs 22. The longitudinal bus bar 20 is formed into a given configuration by cutting off or dividing the strap-like portion 21, or by cutting off unnecessary insulation displacement terminals 23, if necessary.

Figure 5:
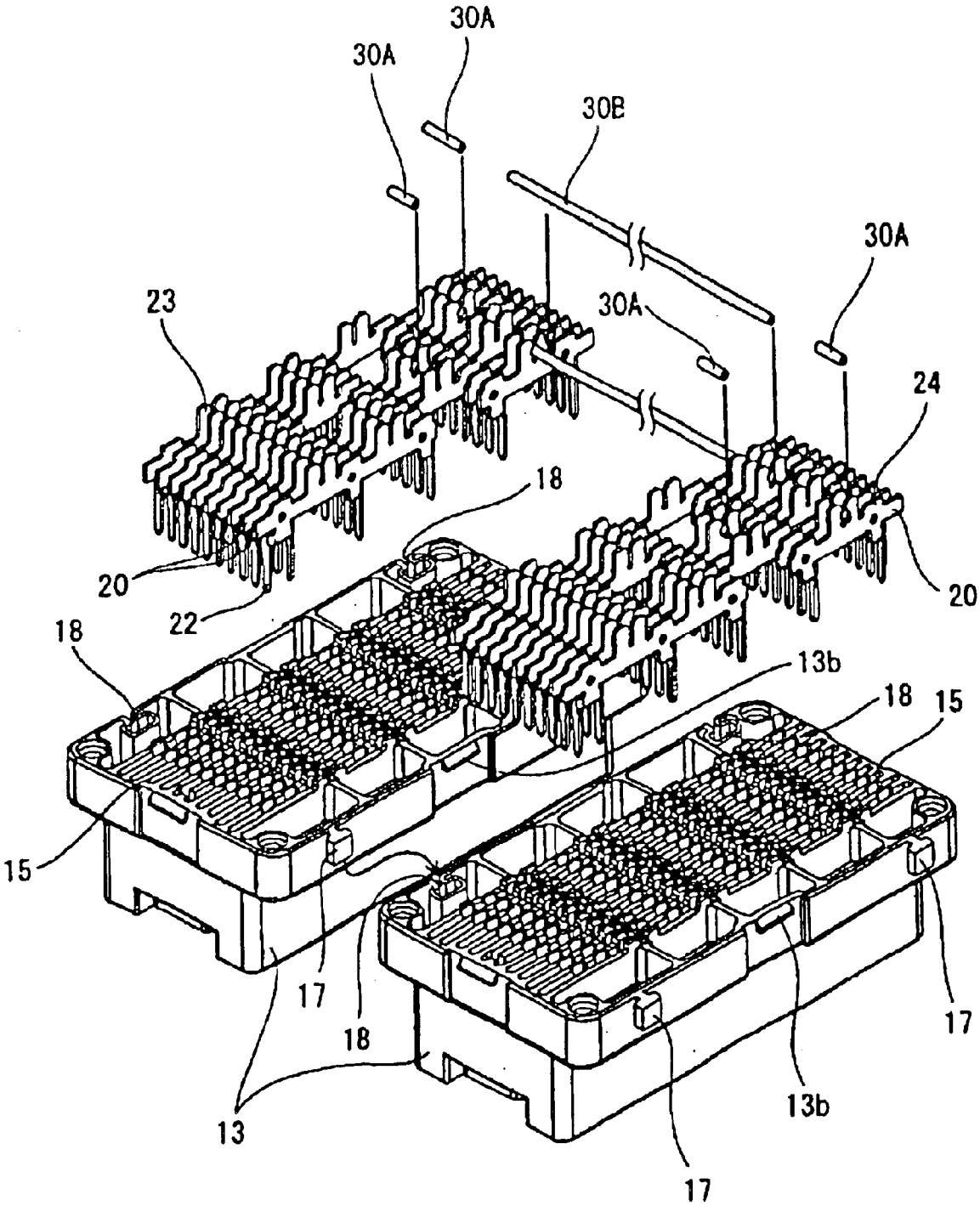
FIG. 5 is an exploded perspective view of a standard box.

As shown in FIG. 5, the male coupling portions 17 of one main casing 13 can be inserted into the female coupling portions 18 of the other main casing 13. Lock pawl 13*b* of the one main casing 13 can be engaged with the lock portion 13*c* (FIG. 2) of the other main casing 13, so that two main casings 13 are coupled with each other. The longitudinal bus bar 20 can be formed into a given configuration and accommodated in the bus bar containing section 15 in the main casing 13. The tabs 22 of the longitudinal bus bar 20 can be inserted through the terminal holes 16 into the connector containing section 14. Furthermore, a jumper cable 30A having a single core wire can be pushed into the insulation displacement terminals 23 of the bus bars 20 to electrically couple the bus bars 20 to one another. In the present embodiment, a jumper cable 30A electrically couples the longitudinal bus bars 20 contained in the same main casing 13 to one another while a jumper cable 30B electrically couples the longitudinal bus bars 20 contained in the different main casings 13 to one another.

Figure 6:
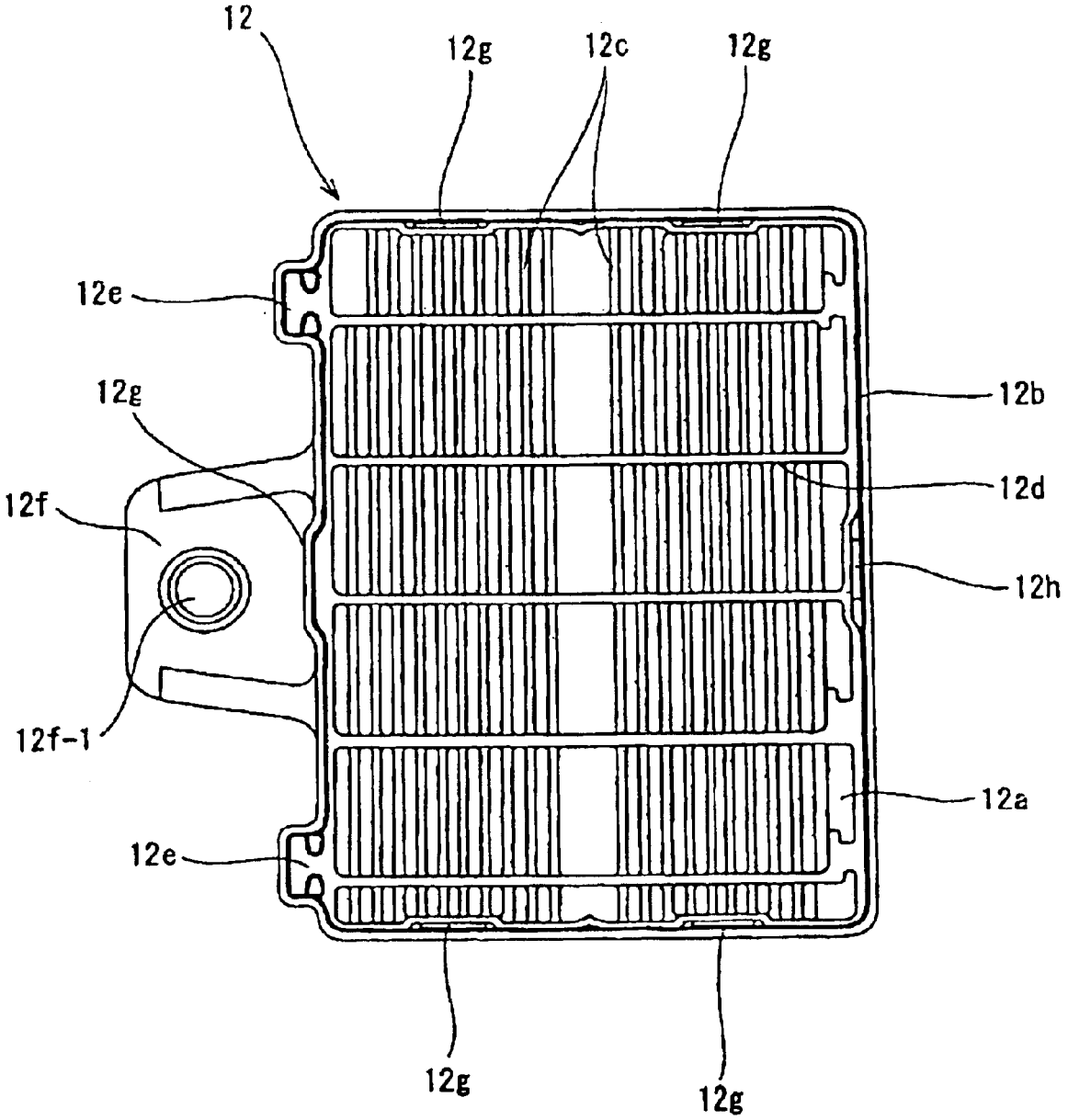
FIG. 6 is a plan view of a lower casing member.

FIG. 6 shows a lower casing member 12. The lower casing member 12 can contain two small size standard boxes, such as boxes 11 shown in FIG. 1. The lower casing member 12 includes a bottom wall 12*a* and sidewalls 12*b*. The bottom wall 12*a* may be provided on an inner surface with bus bar receiving grooves 12*c* that extend in a direction along the longitudinal bus bars 20 and with straight ribs 12*d* that extend in a direction perpendicular to the bus bar receiving grooves 12*c*. The ribs 12*d* can be provided on the positions opposed to the protrusions 24 of the longitudinal bus bars 20 when a standard box containing the bus bars 20 is accommodated in the lower casing member 12. A sidewall 12*b* may project outwardly at the positions corresponding to the male coupling portions 17 of the main casing 13 to provide containing portions 12*e* for the male coupling portion 17. The sidewall 12*b* may also be provided with an attachment portion 12*f* for a vehicle body that has a bolthole 12*f*-1. Further, the sidewall 12*b* can be provided on given positions thereof with the lock hole 12*g* and lock pawl 12*h*.

The lower casing member 12 houses two coupled standard boxes (FIG. 5). At this time, the insulation displacement terminals 23 projecting downwardly from the longitudinal bus bars 20 (FIG. 5) may be received in the bus bar containing grooves 12*c* in the lower casing member 12 while the ribs 12*d* contact with the protrusions 24 of the longitudinal bus bars 20 so that the longitudinal bus bars 20 are surely inserted into regular positions in the bus bar containing sections 15. The male coupling portions 17 on the main casing 13 that are not coupled to the female coupling portions 18 may be accommodated in the containing portions 12*e* for the male coupling portions 17 of the lower casing member 12. The lock pawls 13*a* and 13*b* of the main casing 13 can then be inserted into the lock holes 12*g* in the lower casing member 12 while the lock pawl 12*h* of the lower casing member 12 can be inserted into the lock portion 13*c* (FIG. 2) of the main casing 13. Thus, the standard box 11 can be joined and locked on the lower casing member 12.

After the bolthole 12*f*-1 in the vehicle body attachment portion 12*f* of the lower casing 12 is aligned with a through-hole (not shown) in the vehicle body, the attachment portion 12*f* can be secured to the vehicle body by a bolt, thereby securing the junction box 10 to the vehicle body.

According to the above structure, it is possible to provide the small size standard box 11 that can be used in different kinds of automobile vehicles, to couple a plurality of standard boxes 11 to one another in accordance with a special requirement, to accommodate the coupled standard boxes 11 together in a single lower casing member 12, and to produce a junction box in compliance with the different kinds of automobile vehicles. Since the lower casing member 12 can be provided in accordance with the number of the coupled standard boxes 11 and the main casing 13 and bus bars 20 that have complex structures can be shared respectively, it is possible to reduce man-hours for development of the junction box and lower the cost of a die for a bus bar.

The jumper cable 30A may also be pushed into the insulation displacement terminals 23 provided on the longitudinal bus bars 20 so that any longitudinal bus bars 20 selected from the juxtaposed longitudinal bus bars 20 can be coupled to one another. Therefore, it is possible to easily change the bus bar circuits, enlarge applicability for the small size standard box 11, and apply the standard box 11 to complex circuit structures.

Figure 7:
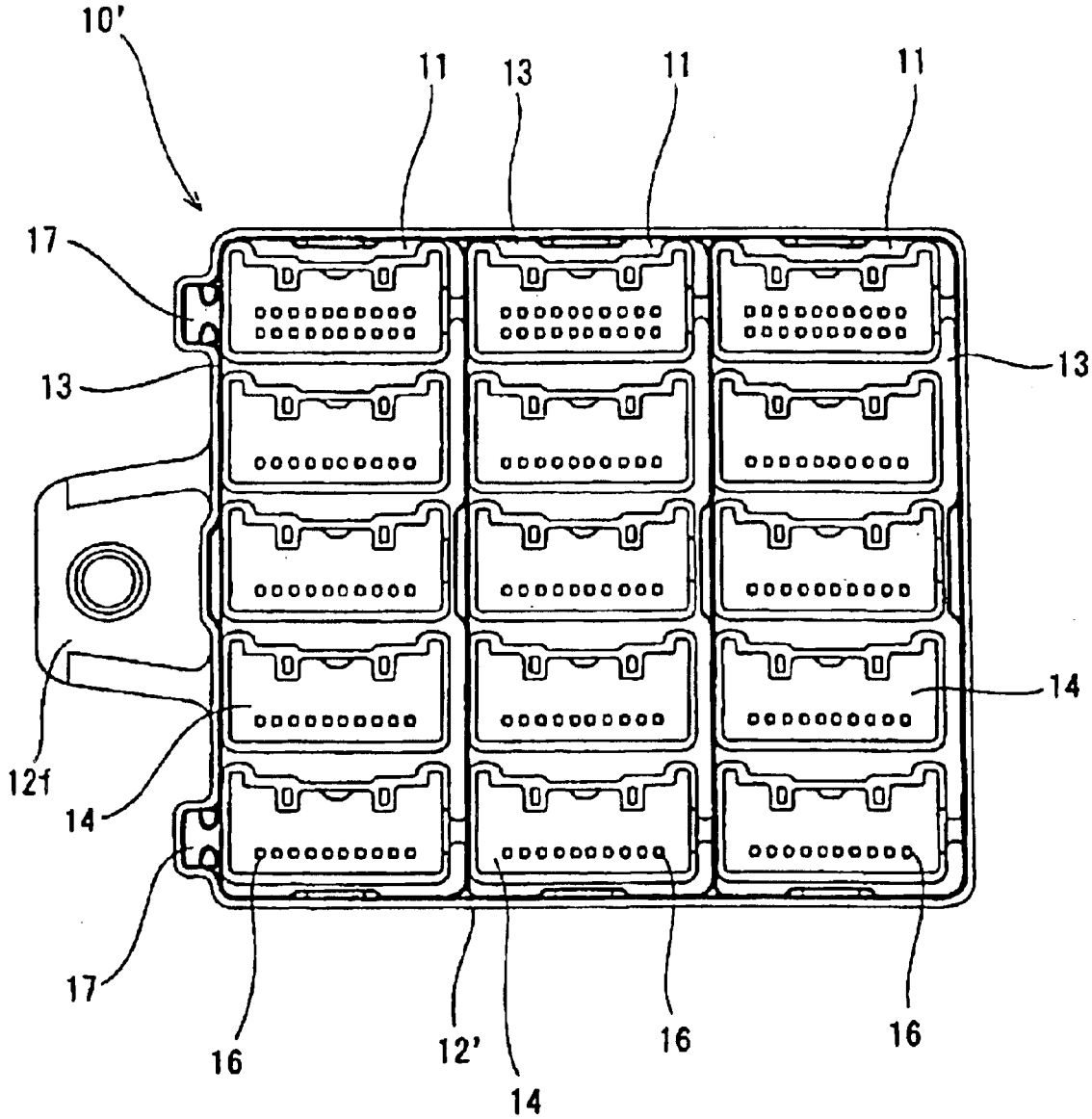
FIG. 7 is a plan view of a second embodiment of a junction box in accordance with the present invention.

FIG. 7 shows another embodiment of the invention in which a junction box 10' includes three coupled standard boxes 11.

Thus, it is possible to form the junction box 10' including three coupled standard boxes 11 merely by providing a lower casing member 12' that can contain three standard boxes 11. That is, it is possible in the invention to form a junction box that can comply with various circuit constructions merely by providing a lower casing member in accordance with the number of standard boxes 11 to be coupled. Since other aspects of this embodiment are the same as the first embodiment, further explanation is omitted.

Figure 8:
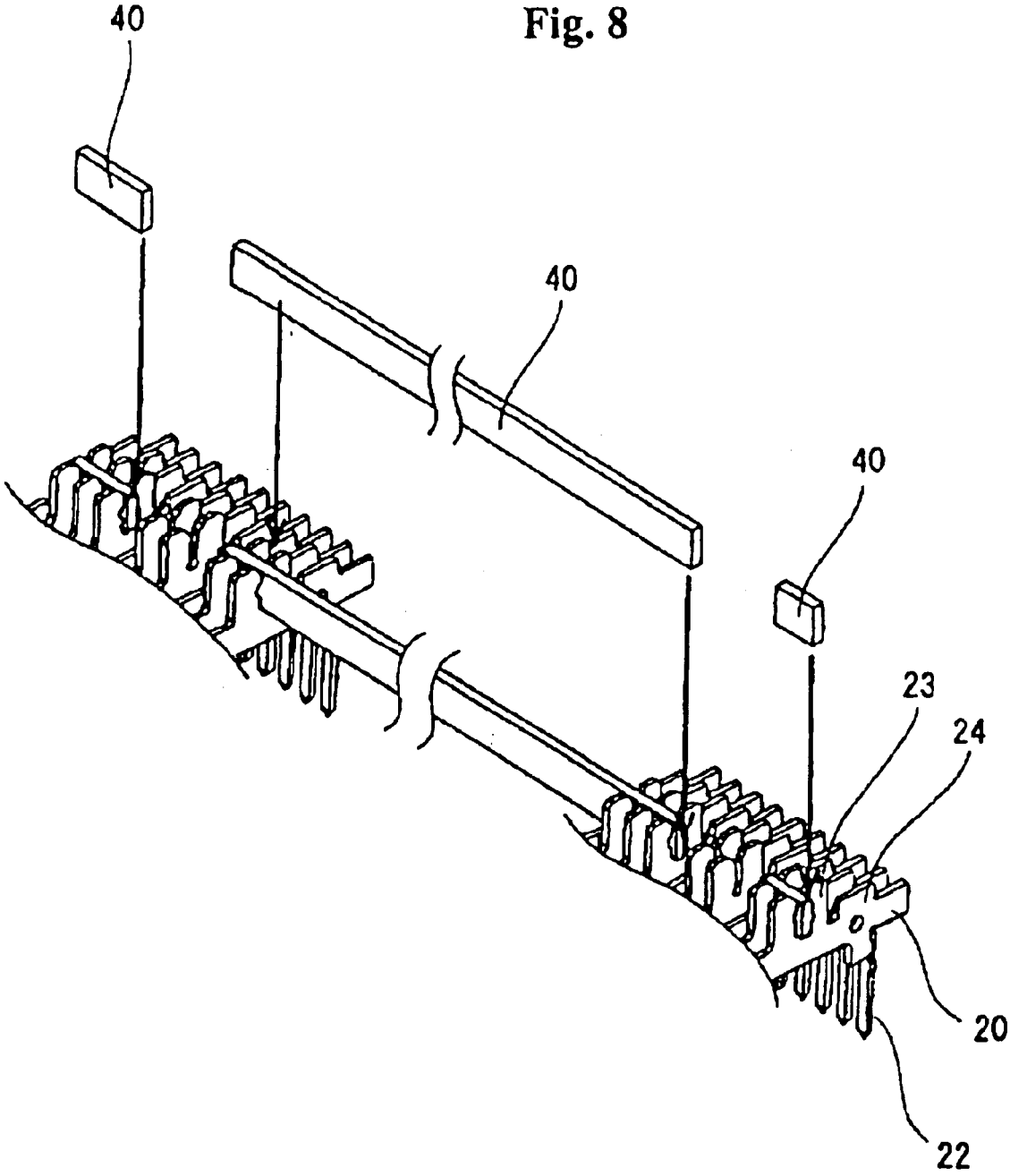
FIG. 8 is a perspective view of a third embodiment of a junction box in accordance with the present invention.

FIG. 8 shows an alternative exemplary embodiment of the invention. In this embodiment, instead of using jumper cable 30, a conductive pin 40 is pushed into the insulation displacement terminals 23 of the longitudinal bus bars 20 to electrically couple the longitudinal bus bars 20 to one another.

Since the above structure can cause the conductive pin 40 to be firmly connected to the insulation displacement terminals 23, it is possible to make reliable electrical connection between the longitudinal bus bars 20. Since other structures of this exemplary embodiment are the same as previous embodiments, further explanation is omitted.

Figure 9:
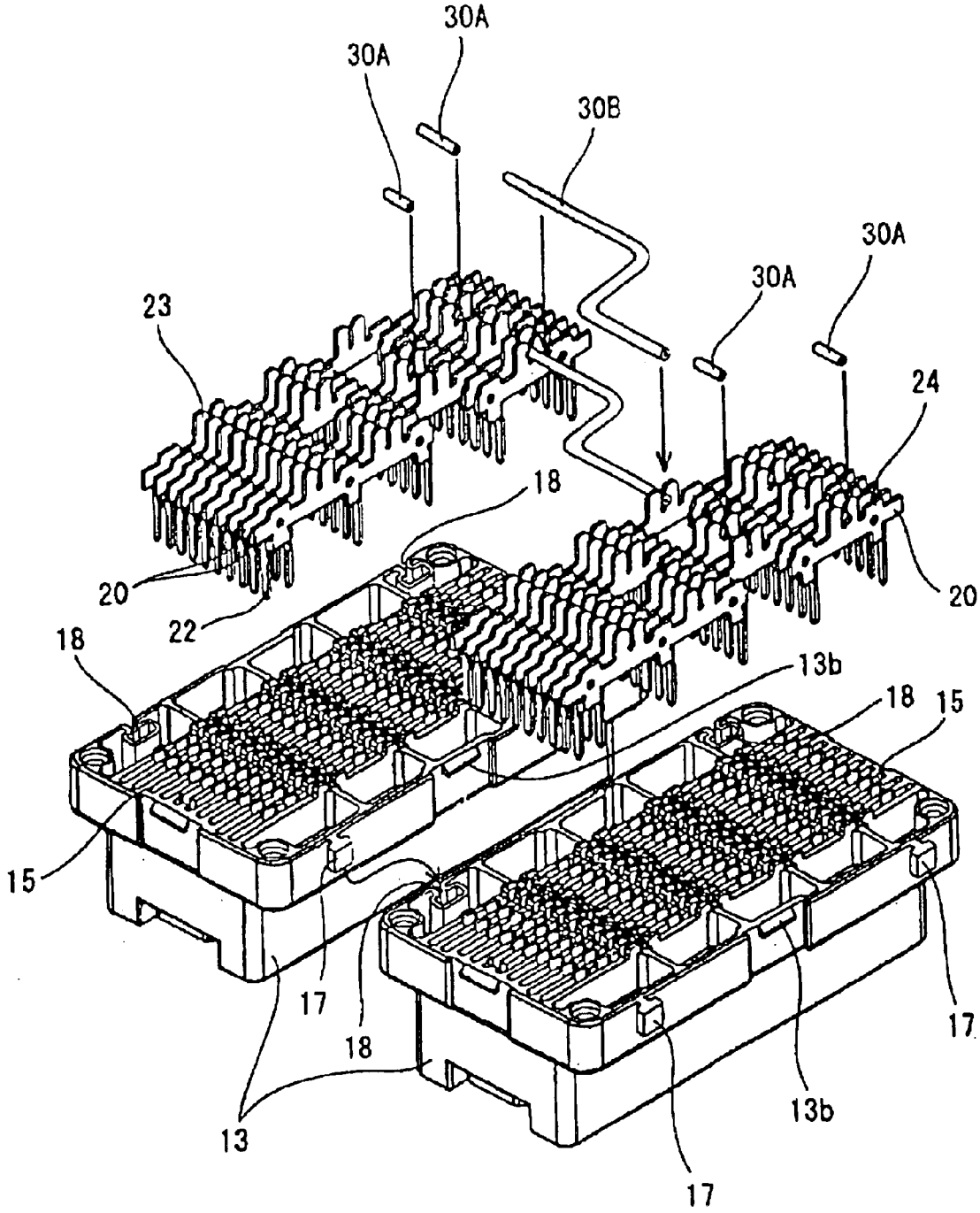
FIG. 9 is an exploded perspective view of a fourth embodiment of the invention.
Figure 10:
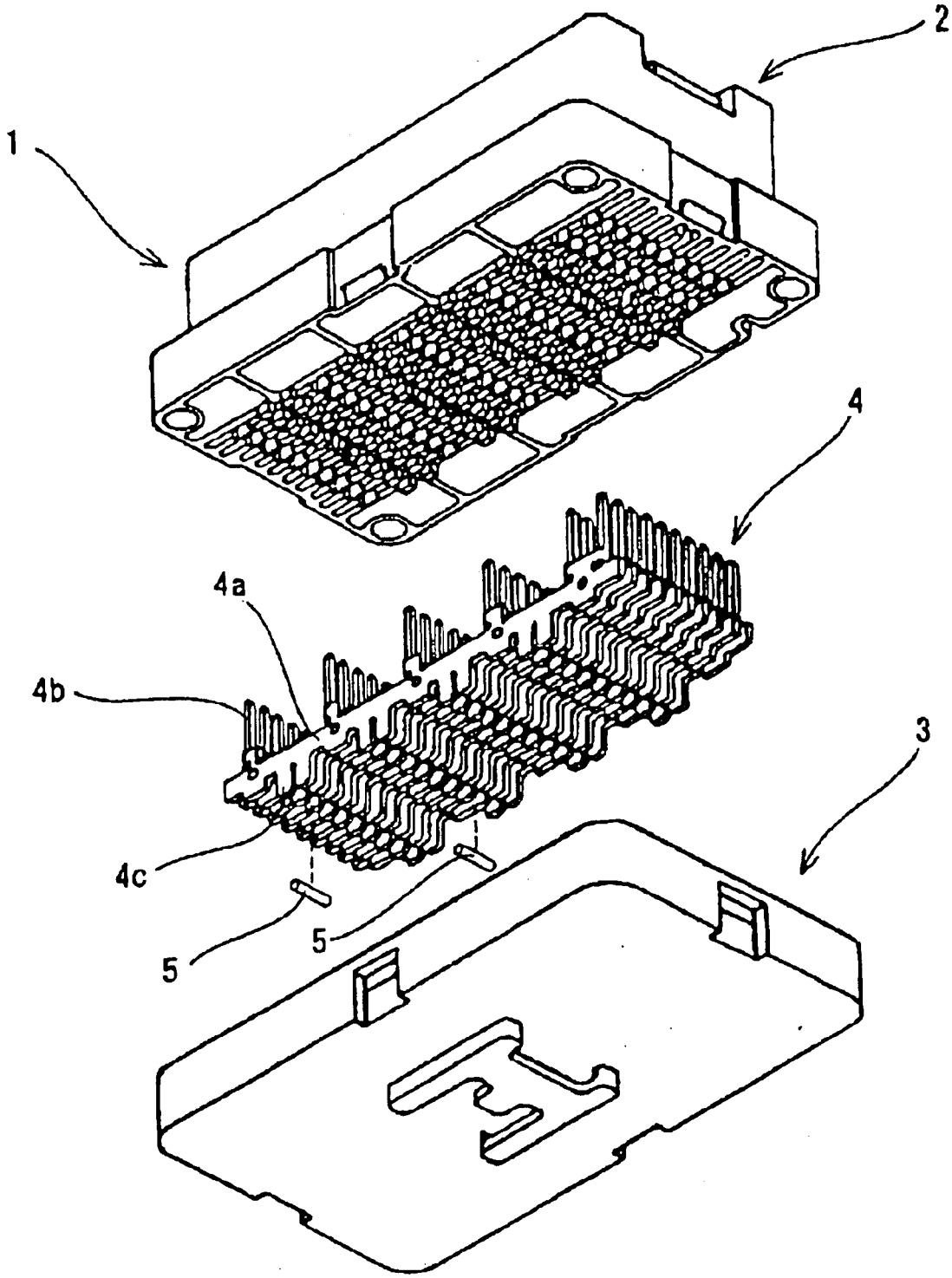
Fig. 10 RELATED ART
FIG. 10 is an exploded perspective view of a conventional junction box.

FIG. 9 shows yet another exemplary embodiment in which a jumper cable 30B is bent and pushed into the insulation displacement terminals 23 of the longitudinal bus bars 20 contained in the different main casings 13 to electrically couple the bus bars 20 to one another. The above structure can enlarge applicability of junction box 10 and can apply the junction box 10 to a complex circuit construction.

The conductive pin 40 in FIG. 8, as well as the jumper cable 30, may be bent and pushed into the insulation displacement terminals 23 of the longitudinal bus bars. Also, the longitudinal bus bars 20 contained in the same main casing 13 may be electrically coupled by the bent jumper cable 30A or conductive pin 40.

While the invention has been particularly described, in conjunction with specific exemplary embodiments, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. A junction box comprising:

a plurality of main casings, wherein each of said main casings contain at least one circuit, and male and female coupling portions provided on the outer opposite side surfaces of each of said main casings;

said plurality of main casings being juxtaposed together in accordance with different types of automobile vehicles by interconnecting said male and female coupling portions successively;

a lower casing member being attached to said main casings, the size of said lower casing member depending on the number of said main casings to be coupled for a special purpose; and said lower casing member being provided with an attachment portion for a vehicle body that projects from said member.

2. The junction box according to claim 1, wherein each of said plurality of main casings contains a plurality of longitudinal bus bars disposed in parallel with one another.

3. The junction box according to claim 2, wherein each of said plurality of longitudinal bus bars have a strap-like portion extending horizontally, and a plurality of tabs projecting vertically from an upper edge of said strap-like portion.

4. The junction box according to claim 3, wherein a plurality of insulation displacement terminals project vertically from a lower edge of said strap-like portion.

5. The junction box according to claim 3, wherein each of said plurality of main casings has a connector containing section to accommodate said plurality of tabs.

6. The junction box according to claim 4, wherein at least one of a jumper cable and a conductive pin is connected to select ones of said plurality of insulation displacement terminals so that selected longitudinal bus bars are electrically coupled to one another.

7. The junction box according to claim 6, wherein said at least one of the jumper cable and the conductive pin electrically couples longitudinal bus bars from at least two different ones of said plurality of main casings.

8. The junction box according to claim 1, wherein the lower casing member and the main casings are attached via the male coupling portions of the main casings that abut respective containing portions of the lower casing member.

9. The junction box according to claim 1, wherein the main casings have longitudinal opposing ends with a latching device that engages with the lower casing to attach the main casings and lower casing to one another.

10. The junction box according to claim 1, wherein each of the main casings have a side wall with a latching device located at substantially a central position of the sidewall to engage with an engaging portion of the lower casing.

11. The junction box according to claim 7, wherein the at least one of the jumper cable and the conductive pin is bent so as to electrically couple specified longitudinal bus bars of the at least two different ones of said plurality of main casings.

12. A method of coupling a plurality of main casings of the junction box of claim 1, comprising:

configuring the plurality of main casings to one another based on a specified arrangement;

attaching the plurality of main casings via the male and female mating portions;

latching the lower casing with the plurality of main casings; and providing an electrical connection between respective ones of the plurality of main casings.

13. A junction box having a plurality of main casings, a lower casing member, a connector containing section and at least one of a jumper cable and a conductive pin, wherein:

each of the plurality of main casings includes at least one circuit, the main casing having opposing side surfaces that have male and female coupling portions;

a plurality of longitudinal bus bars disposed in parallel with one another, wherein each of the plurality of longitudinal bus bars includes a strap-like portion extending horizontally;

a plurality of tabs projecting vertically from an upper edge of the strap-like portion; and a plurality of insulation displacement terminals projecting vertically from a lower edge of the strap-like portion;

the lower casing member being attached to the plurality of main casings and sized depending on the number of the plurality of main casings to be coupled for a special purpose, the lower casing member also being provided with an attachment portion for a vehicle body that projects from the member;

the connector containing section accommodates the plurality of tabs;

at least one of the jumper cable and the conductive pin is connected to select ones of the plurality of insulation displacement terminals so that selected longitudinal bus bars are electrically coupled to one another; and wherein the at least one of the jumper cable and the conductive pin electrically couples longitudinal bus bars from at least two different ones of the plurality of main casings.

* * * * *